United States Patent [19]

Backman

[11] 4,348,275

[45] Sep. 7, 1982

[54] APPARATUS FOR SEPARATING FINE MATERIAL FROM COARSE MATERIAL

[75] Inventor: Bo G. Backman, Skellefteå, Sweden

[73] Assignee: Linden-Alimak AB, Skellefteå, Sweden

[21] Appl. No.: 173,132

[22] PCT Filed: Mar. 21, 1979

[86] PCT No.: PCT/SE79/00064

§ 371 Date: Nov. 23, 1979

§ 102(e) Date: Nov. 23, 1979

[87] PCT Pub. No.: WO79/00812

PCT Pub. Date: Oct. 18, 1979

[30] Foreign Application Priority Data

Mar. 22, 1978 [SE] Sweden ..... 7803308

[51] Int. Cl.[3] ..... B07B 1/28

[52] U.S. Cl. ..... 209/310; 209/389; 209/324; 198/779

[58] Field of Search ..... 209/324, 310, 358, 283, 209/382, 389, 390; 198/630, 779 P

[56] References Cited

U.S. PATENT DOCUMENTS

| | | | |
|---|---|---|---|
| 532,068 | 1/1895 | Jacobus | 209/390 |
| 1,468,803 | 9/1923 | Contant | 198/630 X |
| 2,052,001 | 8/1938 | Platt | 198/630 X |
| 2,141,362 | 12/1938 | Platt | 198/630 X |
| 2,296,645 | 9/1942 | Marsden | 198/779 X |
| 2,410,147 | 10/1946 | Bleeke | 209/310 X |
| 2,531,292 | 11/1950 | Page | 198/779 X |

FOREIGN PATENT DOCUMENTS

| | | | |
|---|---|---|---|
| 84215 | 4/1894 | Fed. Rep. of Germany | 209/310 |
| 474458 | 3/1927 | Fed. Rep. of Germany | 209/389 |
| 2261859 | 6/1974 | Fed. Rep. of Germany | 209/324 |
| 6214 | of 1903 | United Kingdom . | |
| 299102 | 10/1928 | United Kingdom | 209/310 |
| 1079548 | 8/1967 | United Kingdom | 198/630 |

*Primary Examiner*—Norman Yudkoff

*Attorney, Agent, or Firm*—Schuyler, Banner, Birch, McKie and Beckett

[57] ABSTRACT

This invention relates to an apparatus for separating fine material from coarse material.

The screens at present in use in the mining industry usually are so-called shaking screens. They comprise a screen-cloth, which is subjected to a vibration movement. This type of screen, however, has a very high noise level and also is exposed to heavy wear owing to the vibrations, to which the screen parts are subjected.

The present invention has the object to provide an apparatus of the kind referred to above, in which the noise level and the mechanical wear are substantially lower than at conventional screens.

The apparatus according to the invention comprises a perforated stationary screen-cloth (9) supported by members (10, 11, 12), which are interconnected to a closed chain (17) in such a manner, that the support members can be moved along an endless path, and means (**11*b*, 13, 24) for rotating the portions of the support members (10, 11, 12) abutting the screen-cloth (9**) in the direction opposed to the direction of movement of the support members along the path.

9 Claims, 4 Drawing Figures

APPARATUS FOR SEPARATING FINE MATERIAL FROM COARSE MATERIAL

This invention relates to an apparatus for separating fine material from coarse material, comprising a stationary perforated screen-cloth, a number of support members, means for jointing the support members to each other to form a closed chain in such a manner, that every support member extends transversely to the longitudinal direction of the screen-cloth and has a length corresponding substantially to the width of the screen-cloth, means for controlling and advancing the support members along a closed path, so that several of the support members carry the screen-cloth.

The screens at present in use, for example in the mining industry, for separating fine material from coarse material usually are so-called shaking screens, which comprise a screen-cloth subjected to a vibratory movement whereby the material on the screen is caused to "migrate about" on the cloth and thereby improves the efficiency of the separating operation. Screens of this type, however, have a very high noise level and also are heavily worn, due to the vibrations the screen parts are exposed to.

A machine for grading fruits also is previously known, which to a certain extent is similar in principle to the apparatus according to the present invention. There are, however, several very important structural differences between them owing to which the apparatus according to the invention has a better mode of operation than said known fruit grading machine.

The present invention has the object to provide an apparatus for separating fine material from coarse material, which apparatus has a substantially lower noise level and also operates more calmly than conventional screens, so that the mechanical wear is much less than at conventional screens.

The object of the invention is achieved by an apparatus having the characterizing features defined in the attached claims.

Figure 1:
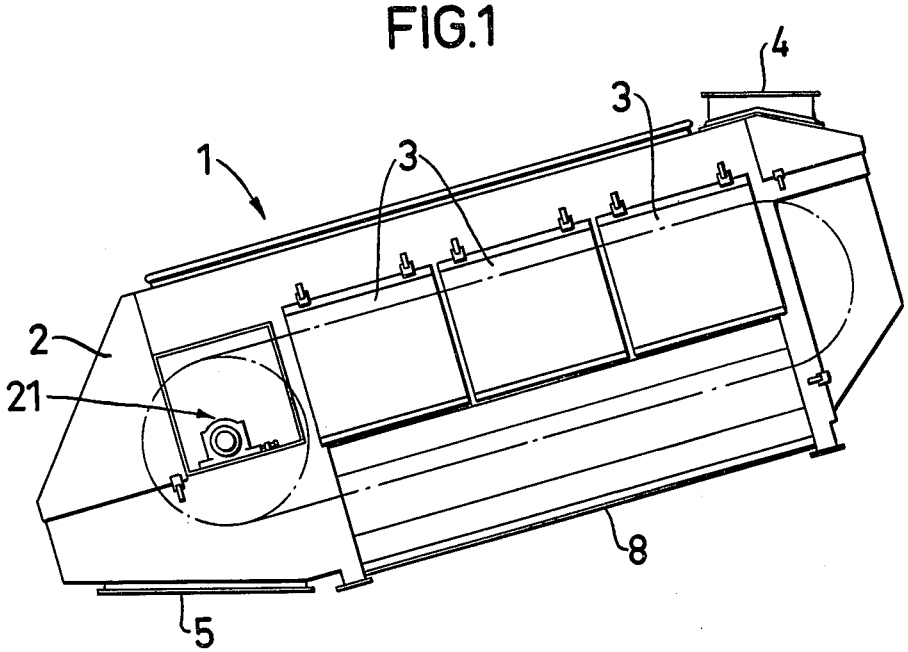
Figure 2:
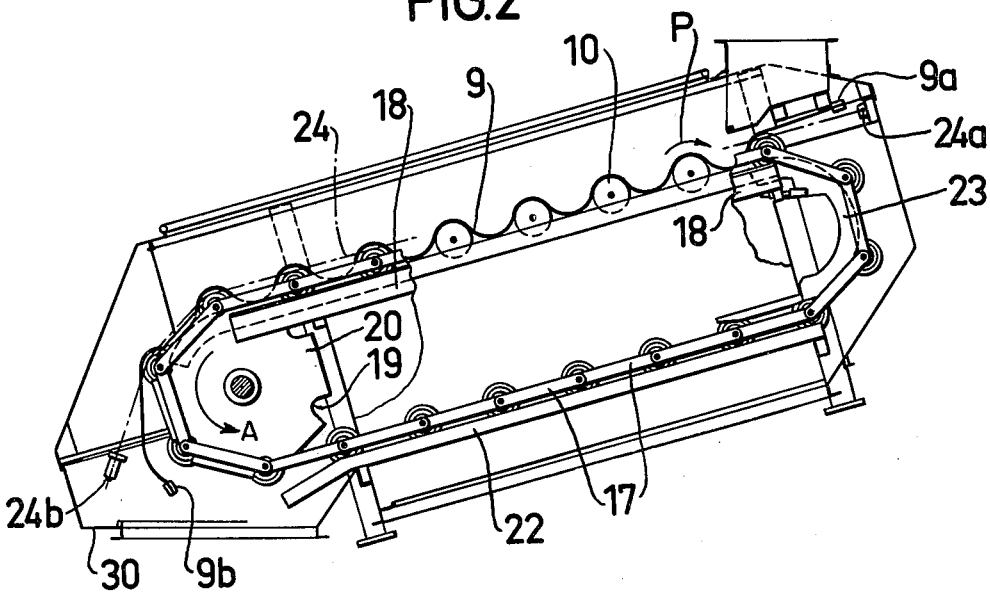
Figure 3:
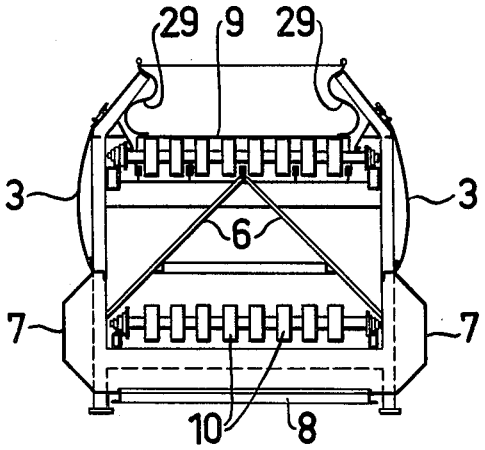
Figure 4:
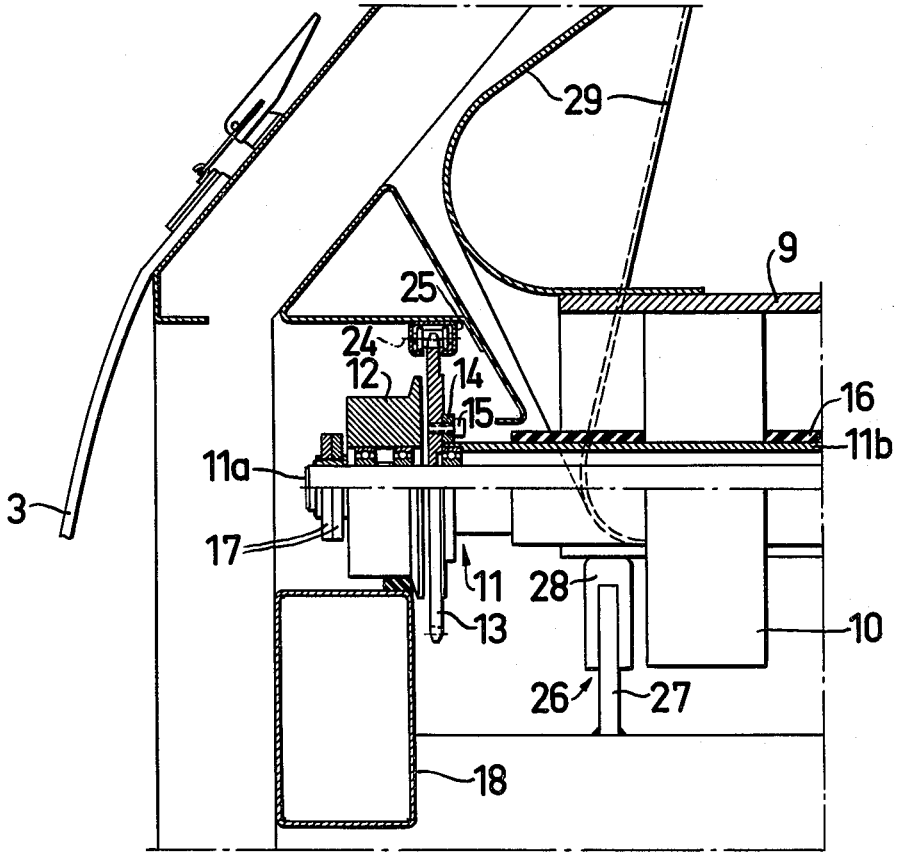

An embodiment of the invention is described in the following, with reference to the accompanying drawings, in which FIG. 1 is a lateral view of the casing enclosing the apparatus, FIG. 2 is a lateral view of the apparatus proper according to the invention, of which certain parts have been removed for reason of better clearness, FIG. 3 is a schematic sectional view through the apparatus according to the invention, and FIG. 4 is a partial sectional view showing a detail of the bearing and guidance of the carrying rollers.

It appears from the lateral view in FIG. 1 that the casing 2 enclosing the screen 1 is provided with covers 3 for access and inspection.

The material to be screened is supplied at the intake 4 at the feed end of the apparatus while the screened material drops out through the outlet 5 at the discharge end. The material separated during the screening process slides along two metal sheets 6 inclined in opposite directions (FIG. 3), and thereafter the separated material strikes against lateral metal sheets 7 before it drops down through an opening 8 located beneath the screening mechanism proper.

The screening mechanism shown in FIGS. 2 and 3 comprises a screen-cloth 9 in the form of a web, which is secured at its two end points 9*a* and 9*b*. Though not apparent from the Figures, the screen-cloth includes holes, through which the material drops down which has a grain size smaller than the hole diameter, and thereafter slides along the metal sheets 6 as mentioned above.

The screen-cloth 9 is supported between its end points 9*a*, 9*b* by a plurality of sets of carrying rollers 10, each set of which is mounted on a through axle 11. The carrying rollers as shown in FIG. 3 have a constant division along the axle 11.

The axles 11 are provided at their ends with travelling wheels 12, which as appears from FIG. 4 are mounted rotatably on an inner axle 11*a*. Inside of the travelling wheels 12 on one side of the axles 11*a*, chain pinions 13 are mounted which via a collar 14, which is passed through by a bolt 15, are rigidly connected to a pipe 11*b* mounted rotatably on the inner axle 11*a*. On the outside of the pipe 11*b* a wear protection 16, for example of rubber, is attached. transferred to a square section 22. At the opposite end of the square section 22 a guide path of semi-circular shape is provided to transfer the travelling wheel 12 to the right-hand end of the box beam 18.

In connection to the screen-cloth 9, on the same side as the chain pinions 13, a chain 24 runs which is indicated by a dash-dotted line in FIG. 2. Said chain 24 is secured at its end points 24*a* and, respectively, 24*b*, thereby fixing the chain in the longitudinal direction to form a rack adjacent and parallel to the upper run of chain 17.

In FIG. 4 is shown how the chain 24 is received in a groove 25, whereby the chain is fixed in lateral direction.

When a travelling wheel 12 is transferred from the guide path 23 to the right-hand end of the box beam 18, the associated chain pinion 13 engages with the stationary chain 24. Upon its movement along the box beam 18 the chain pinion 13 is caused to rotate in the direction of the arrow P. This rotation continues until the chain pinion 13 in question is disengaged from the chain 24, which disengagement takes place at the left-hand end of the path of movement of the link chain.

In the direction of the link chain movement, between some of the individual carrying rollers 10, elongated support members 26 are located, which comprise a frame 27 of hard material and attached thereon, adjacent the suspending screen-cloth 9, a support pad 28 of elastic material, for example rubber. The support members 26, thus, support the screen-cloth 9 between the carrying rollers 10 and thereby prevent that the screen-cloth 9 due, for example, of nonuniform material supply suspends a substantially longer distance between some than between other sets of carrying rollers 10. The screen-cloth as appears from FIGS. 3 and 4 is provided with longitudinal lateral pieces 29, the upper edges of which are attached upwardly on the casing 2. Said lateral pieces 29 efficiently prevent material to be screened from falling down to the side of the screen-cloth 9. FIG. 4 shows that the lateral pieces 29 are stretched when the screen-cloth 9 suspends between two sets of carrying rollers 10.

The apparatus described above operates as follows. The material supplied through the intake 4 drops down onto the perforated screen-cloth 9, which by the moving carrying rollers 10 is exposed to a wave motion, which propagates from the right to the left in FIG. 2. This wave movement, in combination with the inclination of the screen-cloth 9, causes the material on the screen-cloth 9 to be moved from the right-hand end of the screen-cloth 9 in FIG. 2 to the left-hand end where it drops down and forms a shelf of material at the pocket 30 in the casing. The subsequent material, thus, meets the material shelf before moving on and out through the outlet 5. Hereby an unnecessary wear of the metal sheets of the casing is avoided. During the displacement of the material, the particles having a grain size smaller than the holes in the screen-cloth 9 drop down through the holes and further along the sheets 6 in the way described above.

The wave movement of the screen-cloth as a result of the advancing carrying rollers 10 has the further effect, that the material on the screen-cloth 9 while being moved to the discharge end "floats about" on the screen-cloth 9 and thereby ensures an efficient separation of the free material.

There is a risk that upon the movement of the carrying rollers 10 to the discharge end also the screen-cloth 9 is displaced to said end. This applies also in the case when the carrying rollers 10 are mounted rotatably relative to the inner axle 11*a*. The wave movement, which the screen-cloth is desired to carry out, should thereby be reduced substantially, at least at the right-hand end of the screen-cloth in FIG. 2. This would imply a substantial deterioration of the screening result.

In order to ensure that the screen-cloth 9 is subjected to a strong wave movement along its entire length, the aforementioned mechanism with chain pinions 13 and chain 24 is provided. At the rotation of the chain pinions 13 in the direction of the arrow P, also the pipe 11*b* and the carrying rollers 10 rotated in the direction of the arrow P. The motion of screen-cloth 9 is thereby retarded, i.e., screen-cloth 9 is caused to move to the right in FIG. 2, whereby the aforesaid displacement to the left is counteracted. The screen-cloth thereby is given a wave movement along substantially its entire length.

By using a screen-cloth having greater or smaller holes than the screen-cloth mounted in the apparatus, the size of the material separated can be increased or decreased. It can also be imagined that one and the same screen-cloth includes holes of increasing or decreasing diameter in some direction of the cloth. The shape of the holes may also be varied in many different ways, being for example circular, oval, rectangular, triangular etc.

The speed at which the carrying rollers 10 are to be driven should be between 0.5 and 2 m/s. The most suitable speed for a special type of material, however, should be determined from one case to another.

I claim:

1. In an apparatus for separating fine material from coarse material having an elongated, perforated, non-travelling screen-cloth extending from a feed end toward a discharge end, and travelling support means supporting said screen-cloth and imparting undulating motion thereto, said support means including a plurality of travelling rotatable support members spaced longitudinally with respect to said screen-cloth and extending transversely beneath said screen-cloth, each of said support members contacting portions of the underside of said screen-cloth near the edges thereof and intermediate the edges across the width thereof, while at the same time travelling in a forward direction lengthwise of said screen-cloth toward said discharge end, the improvement comprising means for positively rotating said support members, while they are in contact with said screen-cloth, in a screen-cloth retarding direction toward the feed end to urge all of said contacted portions of the underside of said screen-cloth toward the feed end.

2. The invention of claim 1 wherein said support means includes two endless chains attached to opposite ends of said support members, guide means for guiding said chains along endless paths to cause said support members to pass beneath and contact said screen-cloth, and drive means for moving said chains along said guide means and advancing said support members forwardly.

3. The invention of claim 2 wherein said paths define upper and lower runs for said chains and said support members, said support members contacting said screen-cloth while they travel forwardly along said upper run.

4. The invention of claim 3 wherein said means for positively rotating said support members comprises a substantially stationary rack above and parallel to the upper run of one of said chains, and a pinion at the end of each support member adjacent said rack, each of said pinions being rotatable with its associated support member and engageable with said rack.

5. The invention of claim 4 wherein each of said support members comprises an axle extending between and attached to said chains, a travelling wheel rotatably carried at each end of said axle and engageable with said guide means, and a support roller rotatably carried by said axle between said chains and connected to said pinion.

6. The invention of claim 5 wherein said guide means comprises box beams adapted to carry said travelling wheels, and said drive means comprises a rotatable dog pinion for each chain, said dog pinion having recesses which engage and advance said travelling wheels.

7. The invention of claim 1, 4 or 6 wherein said screen-cloth has upwardly extending side portions.

8. The invention of claim 1, 4 or 6 wherein said screen-cloth has a sufficient length to enable it to hang down between said support members.

9. The invention of claim 1, 4 or 6 wherein said screen-cloth is inclined in its longitudinal direction relative to the horizontal.

* * * * *